US006917150B2

(12) United States Patent
Aoki et al.

(10) Patent No.: US 6,917,150 B2
(45) Date of Patent: Jul. 12, 2005

(54) RAW MATERIAL FOR SHADOW MASK FOR COLOR IMAGE RECEIVING TUBE

(75) Inventors: Shinichi Aoki, Yamaguchi-ken (JP); Toshiyuki Ueda, Yamaguchi-ken (JP); Naomi Yabuta, Yamaguchi-ken (JP); Masahiro Fukumoto, Yamaguchi-ken (JP); Jun Agari, Yamaguchi-ken (JP)

(73) Assignee: Toyo Kohan Co., Ltd., Tokyo (JP)

( * ) Notice: Subject to any disclaimer, the term of this patent is extended or adjusted under 35 U.S.C. 154(b) by 143 days.

(21) Appl. No.: 10/312,388

(22) PCT Filed: Jun. 20, 2001

(86) PCT No.: PCT/JP01/05273

§ 371 (c)(1),
(2), (4) Date: Mar. 31, 2003

(87) PCT Pub. No.: WO02/00955

PCT Pub. Date: Jan. 3, 2002

(65) Prior Publication Data

US 2003/0168960 A1 Sep. 11, 2003

(30) Foreign Application Priority Data

Jun. 26, 2000 (JP) ..... 2000-191716

(51) Int. Cl.[7] ..... H01J 29/80

(52) U.S. Cl. ..... 313/402; 313/403; 313/407; 313/408

(58) Field of Search ..... 313/402, 403, 313/407, 408

(56) References Cited

U.S. PATENT DOCUMENTS 4,306,172 A * 12/1981 Matsukura et al. ..... 313/402
4,558,252 A * 12/1985 Kanto et al. ..... 313/402
5,610,473 A * 3/1997 Yokota et al. ..... 313/402
6,016,029 A * 1/2000 Okayama et al. ..... 313/402
6,258,496 B1 * 7/2001 Makita et al. ..... 430/23

OTHER PUBLICATIONS

DialogIP document; Abstract of JP 9227998 A; Sep. 2, 1997; Nisshin Steel Co Ltd; *Cold Rolled Steel Sheet for Color Picture Tube Color Separating Electrode Structural Body and its Production.*

DialogIP document; Abstract of JP 8027541 A; Jan. 30, 1996; Nisshin Steel Co Ltd; *Steel Sheet for Aperature Grille and Production Thereof.*

DialogIP document; Abstract of JP 5311332 A; Nov. 22, 1993; Nikko Kinzoku KK; *Base Stock Sheet for Aperature Grill.*

DialogIP document; Abstract of JP 1025953 A; Jan. 27, 1989; Nippon Mining Co Ltd; *Shadow Mask and its Production.*

* cited by examiner

*Primary Examiner*—Ashok Patel
*Assistant Examiner*—Anthony Canning
(74) *Attorney, Agent, or Firm*—Browdy and Neimark, P.L.L.C.

(57) ABSTRACT

A subject of the present invention is to provide for a shadow mask material for a color picture tube with excellent tensile strength and excellent high temperature creep strength, a shadow mask made of the shadow mask material and a color picture tube with the shadow mask. Material for a shadow mask is made from low carbon steel containing manganese of equal or more than 0.60 wt % and aluminum of 0.002 to 0.12 wt %. A shadow mask is made of the material and the shadow mask is installed in a picture image tube.

8 Claims, No Drawings

RAW MATERIAL FOR SHADOW MASK FOR COLOR IMAGE RECEIVING TUBE

FIELD OF THE INVENTION

The present invention relates to a shadow mask material used for a color picture tube, a shadow mask and a color picture tube with the shadow mask, particularly to a shadow mask material used for a color picture tube having excellent tensile strength and excellent high temperature creep strength, a shadow mask made from said material and a color picture tube with the shadow mask.

BACKGROUND ART

In a conventional type shadow mask for a color picture tube, a front surface of a cathode ray tube has employed a curved surface (dome type), wherein a surface of a shadow mask is slightly curved and welded at a frame. Material for such a conventional type shadow mask can be deformed so as to fit a dome shape. Therefore, its press formability and shape freezing performance so as to maintain a pressed shape are attached importance.

Watching a curved surface cathode ray tube taxes the eyes since external lights are reflected on the curved surface irregularly. To resolve the drawback, a flat surface cathode ray tube has been long felt needed. In the shadow mask type, it would be difficult to flatten a curved surface employed to a conventional cathode ray tube.

Therefore, it has been desired material suitable for a completely flat shadow mask employed to a conventional shadow mask type cathode tube.

In a shadow mask type cathode ray tube, although several ideas have been recommended in order to flatten a surface of a shadow mask, one of the most preferable industrial methods is an expanded shadow mask method in which tensile force is applied in an upper-lower direction.

In accordance with a predetermined dot pattern, penetrated holes are provided at a shadow mask material by an etching method. While a frame of the shadow mask material is pressurized in a direction opposite to an expanded direction, the shadow mask material is bonded on the frame by welding and so on. Pressurized force applied to the frame is removed so that tensile force is occurred by reversing force of the frame. In order to avoid for occurring secondary electron, thermal reflection, rust and other baneful elements, a black treatment is operated at 450 to 470° C. for 10 to 20 minutes.

Necessary characteristics of material for such an expanded shadow mask are an excellent anti-etching characteristic, sufficient strength against tensile force and a high temperature creep characteristic in the case of the black treatment. In the black treatment, while tensile force caused by the reversion force of the frame is loaded on the shadow mask material, a thermal treatment is operated. A creep phenomenon is occurred on the shadow mask material by thermal energy and the tensile force so that the shadow mask material is elongated. In the case of a television set wherein a shadow mask of which a creep elongation is large and the tensile force is reduced is installed in a cathode ray tube, the shadow mask would be vibrated largely when a sound volume becomes large. It is a reason why color gapping is occurred.

In a conventional art, it has been considered some ideas, that is, a reduction of pressurized force applied to a frame, an improvement of rigidness of the shadow mask material and a cushion material provided at a portion for supporting a speaker and a cathode ray tube. However, at the present stage, a sufficient effect can not be obtained.

Japanese Patent No. 2548133 discloses steel plate material for an aperture grill type shadow mask comprising low carbon steel plate with nitrogen of 40 to 100 ppm and manganese of 0.20 to 0.60 wt %, wherein a creep elongation in the black treatment is reduced by utilizing the low carbon steel plate with high strength and high temperature creep characteristic. A radius of a solution atomic of nitrogen (N) is much smaller than that of a solution atomic of iron (Fe) so that nitrogen can be formed as immersion type solid solution in crystal lattice of iron. It is so called as Cottrell atmosphere. At a high temperature such as a black treatment temperature, diffusion speed of nitrogen is fast in iron so that a movement of dislocation creep can be controlled by forming cloud like Cottrell atmosphere in which nitrogen atoms are gathered around the dislocation creep. Therefore, it has been considered that the creep elongation is reduced.

Japanese Patent Laid-Open Publication No. 11-222628 discloses a technical idea as similar as Japanese Patent No. 2548133. Japanese Patent Laid-Open Publication No. 11-222628 recites a steel plate further including nitrogen of 100 to 170 ppm and manganese of 0.10 to 0.60 wt % in order to avoid for overlapping with a claimed scope of Japanese Patent No. 2548133.

A subject of the present invention is to provide a color picture tube corresponding to the completely flat cathode ray tube described above and to resolve a color gapping problem by improving the rigidness of the shadow mask material, that is, a reduction of a creep elongation of the expanded slot type shadow mask.

DISCLOSURE OF THE INVENTION

The most important technical subject of the present invention is to improve a creep characteristic by adding manganese of equal to or more than 0.60 wt % and aluminum of 0.002 to 0.0 12 wt %. Thus, a creep effect of solid solution N can be improved by controlling precipitation of AlN without reducing an inclusion level.

A shadow mask material for a color picture tube is made of low carbon steel with manganese of equal to or more than 0.60 wt % and aluminum of 0.002 to 0.012 wt %.

A shadow mask material for a color picture tube is made of low carbon steel with carbon of equal to or less than 0.03 wt %, manganese of equal to or more than 0.60 wt % and aluminum of 0.002 to 0.012 wt %.

It is preferable that the shadow mask material described above comprises silicone of equal to or less than 0.01 wt %, phosphorus of equal to or less than 0.10 wt %, nitrogen of 0.010 to 0.020 wt %, sulfur of equal to or less than 0.10 wt %, copper of 0.001 to 0.1 wt % and chromium of 0.001 to 0.1 wt %.

A shadow mask according to the present invention for a color picture tube is made using shadow mask material described above.

A color picture tube according to the present invention is made by installing said shadow mask as described above.

A color picture tube according to the present invention is made by attaching a shadow mask to a frame while tensile forces are applied to said shadow mask along an upper and lower direction.

A color picture tube according to the present invention is produced by attaching a shadow mask to a frame while tensile forces are applied to said shadow mask along an upper and lower direction and a left and right direction of said frame, respectively. In such a color picture tube, it is preferable that tensile force along said right and left direction is less than tensile force along said upper and lower direction.

A shadow mask material according to the present invention is made such that said material is loaded with tensile force of 196 N/mm at a temperature of 450° C. for 60 min. and an elongated ratio of said shadow mask material is equal or less than 0.3%.

A shadow mask according to the present invention is installed in a color picture tube, wherein tensile force of 196 N/mm is loaded at a temperature of 450°C. for 60 min. and an elongated ratio of said material is equal or less than 0.6%.

BEST MODE FOR CARRYING OUT THE INVENTION

In a shadow mask according to the present invention, components contained in a shadow mask material are selected so as to fix (weld) the shadow mask on a frame while strong tensile force is loaded on the shadow mask along an up-down direction. Even if the shadow mask according to the present invention is thermally operated, while little tensile force is applied on a shadow mask in a right-left direction which is weaker than tensile force applied in the up-down direction, excellent high temperature creep strength can be obtained so as to avoid for wrinkles caused by loosening the shadow mask itself.

As low carbon steel for a shadow mask according to the present invention, it is preferable that carbon steel is decarbonized and denitrified by a vacuum degasification method and hot rolled so as to reduce carbon and nitrogen content ratios in the carbon steel. At first, it will be described about kind of atoms included in steel for a shadow mask according to the present invention and a reason why these content ratios are restricted.

Manganese is an important component of the present invention. In order to improve the creep characteristic of the expanded slot type shadow mask, a content ratio of manganese is preferable as much as possible. The lower limit is 0.60 wt % and the upper limit is equal or less than 1.0 wt % in view of a manufacturing cost and the etching characteristic.

As similar as manganese, aluminum is an important component for the present invention. Aluminum is utilized as deoxidizing agent during a manufacturing process and a degree for cleaning the steel can be improved. Therefore, it is preferable that the content ratio be equal to or more than 0.002 wt %, more preferably equal to or more than 0.003 wt %. On the other hand, if the content ratio of aluminum is too high, the steel is embrittled caused by hardening solid solution and the etching characteristic is deteriorated. In addition, AlN is formed by connecting to solid solution N in the steel. The upper limit of the aluminum content ratio is 0.012 wt % since the formation of AlN reduces the content ratio of solid solution N. The creep characteristic would be deteriorated.

Carbon is necessary to harden material by solving into a steel plate so that tensile force and creep strength can be improved. If a carbon content ratio is too high, an amount of carbide is increased. It becomes a reason why an etching characteristic is deteriorated. It is preferable that the upper limit of the carbon content ratio is 0.03 wt %. Regarding the lower limit of the carbon content ratio, 0.0001 wt % is preferable in view of a possibility of actually reducing the level in accordance with the vacuum degasification method or an open coil annealing method with a box type annealing furnace. Preferably, the minimum level is equal or more than 0.0002 wt % and more preferably equal or more than 0.0003 wt %.

Silicon has an adverse influence with respect to the etching characteristic and deteriorates an adhesive characteristic with respect to a black colored layer. Therefore, a content ratio of silicon is preferably as low as possible and the content ratio is preferably equal or less than 0.01 wt %.

An upper limit of a content ratio of phosphorous is 0.10 wt % since phosphorous makes baneful influence to its etching characteristic.

As described above, solid solution of nitrogen in the steel makes material harden and improve tensile strength and creep strength. Therefore, it is necessary to add nitrogen. Further, there is an effect for prevent a dislocation creep from moving by dispersing nitride formed by adding solid solution of nitrogen among crystal grains finely, particularly an effect to improve the creep strength.

Therefore, a content ratio is preferably equal to or more than 0.010 wt %, more preferably equal to or more than 0.012 wt %.

On the other hand, if the content ratio of nitrogen is too high, an amount of nitride is increased excessively. The material is embrittled. It is preferable that a content ratio of nitrogen be equal or less than 0.02 wt %, more preferably equal to or less than 0.017 wt %.

Sulfur is segregated among grain boundary and makes baneful influence to the etching characteristic. It is a reason why the material is embrittled. The content ratio is preferably as low as possible. The content ratio is preferably equal to or less than 0.10 wt %, more preferably equal to or less than 0.05 wt %.

By adding solid solution of copper, steel becomes harder and the tensile force and the creep strength can be improved. Therefore, it is necessary to add copper. The content ratio of copper is preferably equal to or less than 0.001 wt %, more preferably equal to or less than 0. 002 wt % and further more preferably equal to or more than 0.003 wt %.

On the other hand, if the content ratio of copper is too much, an etching speed becomes slower and etching solution is contaminated. Therefore, the content ratio is preferably equal to or less than 0.1 wt %, more preferably equal to or less than 0.08 wt %.

By adding solid solution of chromium into steel, the steel becomes harder and the tensile force and the creep strength can be improved. Therefore, it is necessary to add chromium.

Chromium is apt to form nitride such as CrN by reacting with solid solution of nitride remained in the steel so that nitride is formed and a stabilization effect can be obtained. As the result, blow holes in slab are remarkably reduced and the creep strength is remarkably increased by dispersing micro nitride. It would be a reason why a resistance against the creep elongation is increased in accordance with the movement of the dislocation.

Therefore, a lower limit of the content ratio of chromium is preferably equal to or more than 0.001 wt %. The content ratio is more preferably equal to or more than 0.002 wt % and further more preferably equal to or more than 0.003 wt %.

On the other hand, if the content ratio of chromium is too high, carbonate is formed and a magnetic characteristic is deteriorated. The content ratio is preferably equal to or less than 0.1 wt %, more preferably equal to or less than 0.09 wt % and further more preferably equal to or less than 0.08 wt %.

A method for manufacturing a thin steel sheet for shadow mask material according to the present invention will be described hereinafter. Molten metal having the above described components obtained by a normal molten method is deoxidized by vacuum degasificated gas or aluminum, silicone and others, and passed through continuous casting and hot rolling so as to form a hot rolled steel plate. In an acid cleaning, after descaling, the steel sheet is cold rolled so as to form its thickness within a range of 0.2 to 0.8 mm. Then, the steel sheet is softened by an annealing treatment. The steel sheet is cold rolled so as to form its thickness within a range of 0.05 to 0.20 mm as a furnish treatment. Regarding the annealing treatment, either a box-shaped annealing furnace or a continuous annealing furnace may be used.

A shadow mask according to the present invention will be described.

Water soluble casein-resist is coated on the both surfaces of the shadow mask material as shown in Table 1. Then, dried resist coated on the both surfaces is patterned by a pair of dry plates on which ins and outs patterns are drawn, respectively. After patterning, an exposure treatment, a film hardening treatment and a baking treatment are operated. Then, ferric chloride solution (liquid temperature 60° C., specific gravity 48 Be) is sprayed on the both patterned resist surfaces as etching liquid so as to etch the resist. After etching, the steel sheet is cleaned with alkaline solution so as to peel the resist. In the last manufacturing step, the shadow mask is cleaned and dried.

A condition in which the shadow mask according to the present invention is attached to a frame will be described. The shadow mask according to the present invention is fixed on the frame while tensile force is loaded. Although various methods for fixing a shadow mask on a frame can be considered, a welding method is the best known method. Initially, while a center portion of each upper and lower frame bars of a frame is forcibly flexed toward an inward direction, a shadow mask is fixed on the frame. Then, flexed upper and lower frame portions are returned to original positions, respectively (releasing forcibly force) so that tensile force can be applied to the shadow mask along an up-down direction.

When the shadow mask is fixed on the frame as described above, it is preferable that tensile force along a right-left direction of which amount is less than the tensile force along the up-down direction is loaded. In a color picture tube according to the present invention, it is preferable that strong tensile force is applied along the up-down direction. In addition to the load in the upper-lower direction, the tensile force is also loaded in the right-left direction. Thus the shadow mask can prevent from crinkling by applying the tensile force along the up-down direction. However, if the large amount of tensile force were applied on the shadow mask along the right-left direction, slot holes formed on the shadow mask would be deformed.

Although tensile force loaded on the above shadow mask in the up-down direction is practically several hundreds $N/mm^2$, the shadow mask attached to the picture tube is not deformed if an elongated ratio of the shadow mask loaded with tensile force 196 $N/mm^2$ at a temperature of 450° C. for 60 min. is equal or less than 0.5%.

Regarding a condition of the shadow mask material at a stage before a so-called black treatment, it is better that the above mechanical characteristic be evaluated strictly, since the material would be black treated as a thermal treatment. If the elongated ratio of a shadow mask material loaded with 196 N/mm at a temperature of 450 for 60 min. is equal to or less than 0.3%, the shadow mask attached to the picture tube is not deformed.

EXAMPLE

The embodiments of the present invention will be described in detail hereinafter.

Table 1 shows various steel sheets (A–G) having different chemical components, wherein each steel sheet is vacuum degassed so as to obtain melt slab and the slab is hot rolled so as to obtain a hot rolled sheet having a thickness of 2.5 mm. These hot rolled sheets are acid cleaned with sulphuric acid and cold rolled so as to obtain a cold rolled sheet having a thickness of 0.35 mm. Then, the sheets are annealed in a continuous type annealing furnace and cold rolled so as to obtain test materials having a thickness of 0.10 mm.

TABLE 1

CHEMCIAL COMPOSITION (STEEL SHEET) OF TEST MATERIALS

| Sample | Chemical Composition (wt %) | | | | | | | | | Invention or |
|---|---|---|---|---|---|---|---|---|---|---|
| No | C | Mn | Si | S | P | N | Al | Cu | Cr | Comparison |
| A | 0.010 | 0.65 | 0.010 | 0.006 | 0.012 | 0.0127 | 0.003 | 0.08 | 0.040 | Invention |
| B | 0.025 | 0.68 | 0.010 | 0.007 | 0.012 | 0.0130 | 0.007 | 0.008 | 0.045 | Invention |

TABLE 1-continued

CHEMCIAL COMPOSITION (STEEL SHEET) OF TEST MATERIALS

| Sample | Chemical Composition (wt %) | | | | | | | | | Invention or |
|---|---|---|---|---|---|---|---|---|---|---|
| No | C | Mn | Si | S | P | N | Al | Cu | Cr | Comparison |
| C | 0.019 | 0.78 | 0.009 | 0.005 | 0.014 | 0.0148 | 0.005 | 0.06 | 0.055 | Invention |
| D | 0.022 | 0.95 | 0.010 | 0.008 | 0.015 | 0.0155 | 0.010 | 0.06 | 0.054 | Invention |
| E | 0.015 | 0.33 | 0.013 | 0.012 | 0.009 | 0.0090 | 0.009 | 0.006 | 0.055 | Comparison |
| F | 0.021 | 0.36 | 0.004 | 0.008 | 0.013 | 0.0113 | 0.018 | 0.005 | 0.004 | Comparison |
| G | 0.023 | 0.62 | 0.011 | 0.015 | 0.010 | 0.0124 | 0.032 | 0.03 | 0.050 | Comparison |

Table 2 shows the result of characteristic experiments with respect to each obtained test material. Instron type testing machine is used for a tensile test and a creep tester (manufactured by Tokai Seisakusho) is used for a creep elongation test. Regarding the tensile experiment, the elongated ratio is measured by comparing an elongated ratio (%) of a test material loaded with the tensile force 196 N/mm$^2$ at a temperature of 450° C. for 60 min. and an elongated ratio (%) of a test material repeatedly loaded with the tensile force 196 N/mm$^2$ at the temperature of 450° C. for 20 min. three times. Regarding the creep strength, the following standard is utilized.

A reference value of a creep elongated ratio (%) is designated "equal to or less than 0.3%" as a characteristic of a shadow mask material as shown in Table 2. As described above, the shadow mask welded on a frame is heat treated so as to black treat. In order to maintain tensile force applied to the shadow mask attached on the frame without loosing, the above reference value of the creep elongated ratio (%) is determined as an experiment condition for shadow mask material. As the experiment condition, the shadow mask material is loaded with tensile force 196 N/mm at a temperature of 450 for 60 min. before measuring the creep elongated ratio. If the elongated ratio is equal to or less than 0.3 %, such shadow mask material can be applicable to a flat type shadow mask in the case that the shadow mask is installed in a picture tube.

In an actual color picture tube, several heating treatments such as a baking treatment and a glass sealing treatment are operated with respect to the black treated shadow mask material installed in a picture tube. Therefore, the creep elongation ratio of the shadow mask would be higher than the elongated ratio of the above described shadow mask material. Upon reviewing the above actual manufacturing step, the present invention designates the elongated ratio of the shadow mask material equal or less than 0.6%, wherein the shadow mask is repeatedly loaded with tensile force 196 N/mm$^2$ at a room temperature for 20 min. and at a temperature of 450° C. for 20 min. three times.

TABLE 2

| | Properties of sample | | | | |
|---|---|---|---|---|---|
| | Experiment items | | | | |
| | Characteristics of Shadow mask material | | Characteristics of shadow mask | | |
| Sample No Reference value | Tensile strength (N/mm$^2$) ≧588 | Creep elongate ratio (%) ≦0.3 | Creep elongate ratio (%) ≦0.6 | Judgement | Invention or Comparison |
| A | 805.6 | 0.20 | 0.28 | ○ | Invention |
| B | 818.3 | 0.17 | 0.22 | ○ | Invention |
| C | 829.1 | 0.14 | 0.18 | ○ | Invention |
| D | 845.7 | 0.12 | 0.15 | ○ | Invention |
| E | 702.7 | 0.33 | 0.49 | X | Comparison |
| F | 743.8 | 0.43 | 0.58 | X | Comparison |
| G | 785.0 | 0.44 | 0.63 | X | Comparison |

If the elongated ratio is equal to or less than 0.6%, the shadow mask material can be used as a flat type shadow mask in the case that the shadow mask is installed in a picture tube. Thus, the reference value of the creep elongate ratio as the characteristic of the shadow mask is designated as 0.6%.

As shown in Table 2, regarding the all characteristics, test materials according to the present invention are excellent so that marks of "○" can be indicated at judgement spaces as a total evaluation. On the other hand, comparisons, which are not included in a range recited in the present invention, are inferior with respect to at least one characteristic. Therefor, marks of "x" are indicated at judgement spaces as the total evaluation.

INDUSTRIAL APPLICABILITY

Material according to the present invention for a slot type shadow mask utilized for a color picture tube has excellent etching characteristics. The slot type shadow mask and an image picture tube installing the shadow mask have excellent tensile strength and excellent high temperature creep strength so that a cathode ray tube in a conventional shadow mask type can make a mask surface completely flat.

What is claimed:

1. A shadow mask material for a color picture tube comprising low carbon steel with manganese of 0.60 wt % to 1.0 wt %, aluminum of 0.002 to 0.012 wt %, carbon equal to or less than 0.03 wt %, silicon of equal to or less than 0.01 wt %, phosphorus of equal to or less than 0.10 wt %, nitrogen of 0.010 to 0.020 wt %, sulfur of equal to or less than 0.10 wt %, copper of 0.001 to 0.10 wt %, and chromium of 0.001 to 0.10 wt %.

2. A shadow mask for a color picture tube made of shadow mask material as claimed in claim 1.

3. A color picture tube with said shadow mask claimed in claim 2.

4. A color picture tube with a shadow mask as claimed in claim 2, wherein said shadow mask is attached to a frame while tensile forces is applied to said shadow mask along an upper and lower direction.

5. A color picture tube with shadow mask as claimed in claim 2, wherein said shadow mask is attached to a frame while tensile forces is applied to said shadow mask along an upper and lower direction and a left and a right direction of said frames, respectively.

6. A color picture tube with shadow mask as claimed in claim 5, wherein tensile force along said right and left direction is less than tensile force along said upper and lower direction.

7. Shadow Mask material for a color picture tube as claimed in claim 1, wherein said material is loaded with tensile force of 196N/mm$^2$ at a temperature of 450° C. for 60 min. and an elongated ratio of said shadow mask material is equal or less than 0.3%.

8. A shadow mask for a color picture tube as claimed in claim 1, wherein tensile force of 196N/mm$^2$ is loaded at a temperature of 450° C. for 60 min. and elongated ratio of said material is equal or less than 0.6%.

* * * * *